US009722348B2

(12) United States Patent
Zebhauser et al.

(10) Patent No.: US 9,722,348 B2
(45) Date of Patent: Aug. 1, 2017

(54) SYSTEM HAVING A PLURALITY OF PLUG-IN CONNECTORS AND MULTIPLE PLUG-IN CONNECTOR

(71) Applicant: ROSENBERGER HOCHFREQUENZTECHNIK GMBH & CO. KG, Fridolfing (DE)

(72) Inventors: Martin Zebhauser, Laufen (DE); Martin Singhammer, Fridolfing (DE); Christian Schmidt, Wernberg-Köblitz (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/903,688

(22) PCT Filed: Jul. 8, 2014

(86) PCT No.: PCT/EP2014/001903
§ 371 (c)(1),
(2) Date: Mar. 21, 2016

(87) PCT Pub. No.: WO2015/003810
PCT Pub. Date: Jan. 15, 2015

(65) Prior Publication Data

US 2016/0218460 A1 Jul. 28, 2016

(30) Foreign Application Priority Data

Jul. 11, 2013 (DE) ..... 20 2013 006 295 U

(51) Int. Cl.
*H01R 13/64* (2006.01)
*H01R 13/514* (2006.01)
(Continued)

(52) U.S. Cl.
CPC ..... *H01R 13/514* (2013.01); *H01R 13/506* (2013.01); *H01R 13/6463* (2013.01)

(58) Field of Classification Search
CPC ..... H01R 13/514; H01R 33/76; H01R 13/64
(Continued)

(56) References Cited

U.S. PATENT DOCUMENTS 6,328,601 B1 * 12/2001 Yip ..... H01R 4/2429 439/607.08
6,380,485 B1 * 4/2002 Beaman ..... H01R 9/035 174/88 R
(Continued)

FOREIGN PATENT DOCUMENTS

DE 20 2006 013075 U1 11/2006
DE 20 2012 007577 U1 9/2012
EP 1 575 136 A2 9/2005

*Primary Examiner* — Abdullah Riyami
*Assistant Examiner* — Thang Nguyen
(74) *Attorney, Agent, or Firm* — DeLio, Peterson & Curcio, LLC; Robert Curcio

(57) ABSTRACT

A system having a plurality of plug-in connectors each with a housing, the shape of the housings differing such that the housings have first housing parts which, at least in terms of the interface connections to second housing parts, are identical to the other components of the particular plug-in connector, and second housing parts having identical connecting means for connecting with the first housing part, and differ slightly in the external shape which serves to form a coding by which the individual positions of the individual plug-in connectors on or in the multiple housing are assigned.

4 Claims, 7 Drawing Sheets

(51) Int. Cl.
*H01R 13/506* (2006.01)
*H01R 13/6463* (2011.01)

(58) Field of Classification Search
USPC ..... 439/701, 680, 634, 686, 695, 677
See application file for complete search history.

(56) References Cited

U.S. PATENT DOCUMENTS

| | | | | |
|---|---|---|---|---|
| 7,195,518 | B2 * | 3/2007 | Bert | H01R 4/2441 439/290 |
| 2003/0077927 | A1 * | 4/2003 | Momota | H01R 9/226 439/76.2 |
| 2005/0287873 | A1 * | 12/2005 | Carroll | H01R 13/6463 439/676 |
| 2009/0209140 | A1 * | 8/2009 | Heggemann | H01R 13/6453 439/680 |
| 2011/0294361 | A1 * | 12/2011 | Schrader | H01R 13/64 439/680 |
| 2012/0171884 | A1 * | 7/2012 | Dang | H01R 13/6463 439/310 |
| 2012/0309221 | A1 * | 12/2012 | Scherer | H01R 13/514 439/374 |

* cited by examiner

SYSTEM HAVING A PLURALITY OF PLUG-IN CONNECTORS AND MULTIPLE PLUG-IN CONNECTOR

BACKGROUND OF THE INVENTION

1. Field of the Invention

The invention relates to a system comprising a plurality of plug-in connectors which differ in their outer shape as well as a multiple plug-in connector featuring such a system. The plug-in connectors are intended, in particular, for a connection with twisted-pair cables and for the transmission of high frequency signals.

2. Description of Related Art

Twisted-pair cables have long been known from the field of signal and data transmission. "Twisted-pair" refers to cables in which the wires (i.e. the individual conductors of the cable which are surrounded by an insulating sheath) are twisted together in pairs. In comparison with cables in which the wire pairs are parallel, twisted-pair cables with their twisted wire pairs provide better protection against external alternating magnetic fields and electromagnetic influences, since with a symmetrical signal transmission the twisting of the wire pairs largely cancels out the influence through external fields.

Plug-in connectors are used in order to connect together electrically conductive components, for example cables, in an electrically conductive manner.

When connecting a twisted-pair cable with a conventional plug-in connector, a section of the outer cable sheath surrounding the wires is removed. Then the ends of the wires, additionally stripped of their insulating sheathing, are permanently connected with contact elements of the plug-in connector. The contact elements are in turn fixed in the housing of the plug-in connector. Within the housing, i.e., in the section in which the cable sheathing has been removed, the wires substantially run parallel. This section of the twisted-pair cable could thus be exposed to a stronger influence through external fields.

In order to avoid such an increased influence, a shielding is generally integrated in the plug-in connector and in particular in the housing of the plug-in connector. However, this leads to relatively high costs for the plug-in connector, since it rules out the possibility of forming the housing, economically, exclusively from electrically insulating or non-conductive plastics.

It is also known for a series of plug-in connectors, distinguished by a substantially standard plug interface, to be modified in such a way that these can only be connected with matching mating plug-in connectors. Such codings for the plug-in connectors can for example be provided in the form of simple projections which differ, in the different plug-in connectors, in terms of their arrangement on the housings and/or in their dimensions and which engage into correspondingly arranged and/or dimensioned recesses in the matching mating plug-in connectors.

A disadvantage of a coding integrated in the housing of the plug-in connector is that this increases the costs of manufacturing the plug-in connector. This is in particular the case if the housings of the plug-in connector are manufactured by means of plastic injection molding, since the different codings require different injection molding tools. Furthermore, a large number of different molds for housing parts of plug-in connectors can lead to high stock-keeping costs in connection with the assembly of the plug-in connectors.

It is noted that DE 20 2006 013 075 U1 discloses a connection system for connecting wire pairs of a multi-pair data cable to connection pairs of a data socket. This system comprises a cable with four wire pairs, whereby the four wire pairs are arranged in an accommodating device, and a socket with four connection pairs for making contact with the four wire pairs in a predetermined assignment. A rotatable assignment device is arranged between the accommodating device and the socket. It is possible to establish correct contact between the wire pairs and the connection pairs depending on the rotation positions of the accommodating device, the assignment device and the socket relative to one another.

It is also noted that US 2005/0287873 A1 discloses a single plug-in connector which can be provided with three different caps: either with a dust protection cap or with a pull-ring cap for laying a cable or with a RJ45 adapter cap 262, which is used for the operation of the plug-in connector. The dust protection cap is used for transport and the pull-ring cap for laying the cable in a conduit.

The publication DE 20 2012 007 577 U1 discloses a (multiple) plug-in connector with a housing and a plurality of contact element pairs fixed in the housing which are designed to make contact with complementary contact element pairs of a mating plug-in connector.

SUMMARY OF THE INVENTION

Starting out from this prior art, the invention was based on the problem of providing a possibility of economically manufacturing a several plug-in connectors which differ in terms of the shape of their housing.

This problem is solved by a system having a plurality of plug-in connectors according to the independent claims. A multiple plug-in connector having such a system is the subject matter of the claims. Advantageous embodiments of the system according to the invention and of the multiple plug-in connector according to the invention are the subject matter of the various dependent claims and are explained in the following description of the invention.

The above and other objects, which will be apparent to those skilled in the art, are achieved in the present invention which is directed to a multiple plug-in connector having the following features: a system comprising: a plurality of plug-in connectors, each with a housing, the housings differing in shape; and a multiple housing fixing in place the plug-in connectors, wherein the housings have first housing parts which are identical in shape and dimensions and differing second housing parts, the second housing parts of at least some of the plug-in connectors including different codings for assignment to individual positions on or in the multiple housing which are formed by recesses into which projections of the multiple housing engage.

The second housing parts preferably have identical connections for connecting with the first housing parts.

The multiple plug-in connector may further include contact elements arranged in the first housing parts.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
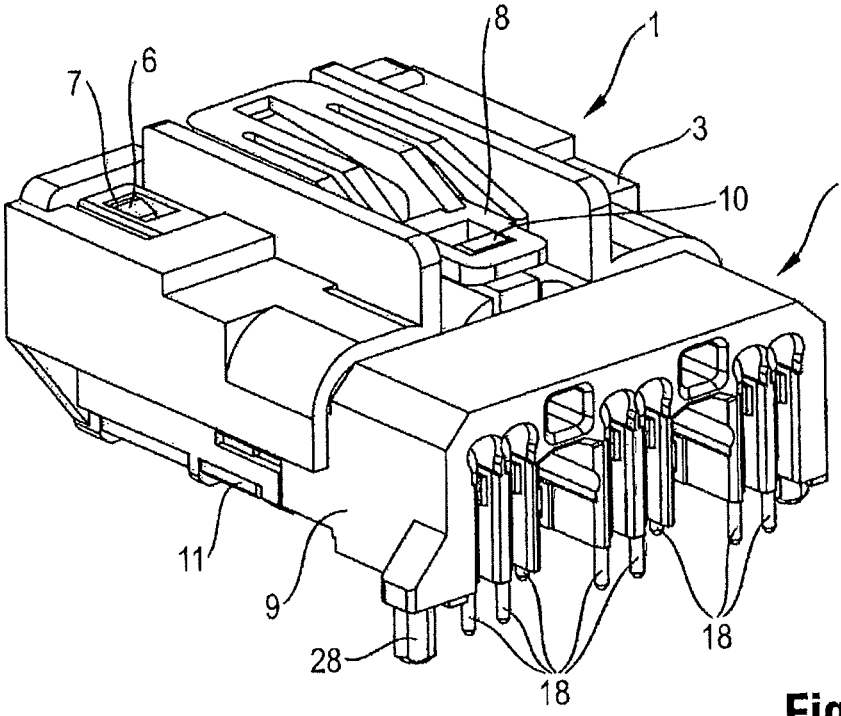
FIG. 1 shows a multiple plug-in connector according to the invention with a mating plug-in connector.
Figure 2:
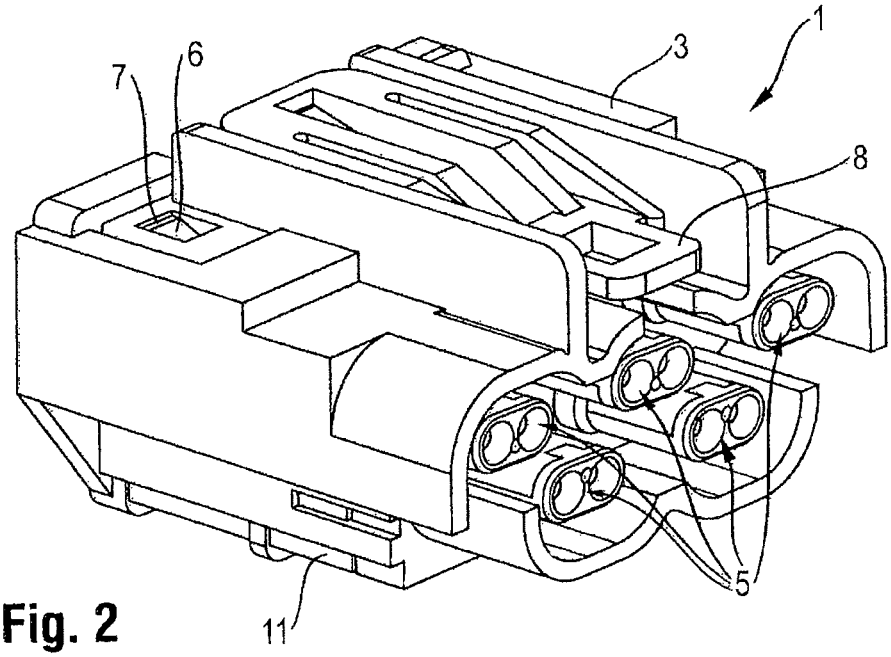
FIG. 2 shows a first view of the multiple plug-in connector.
Figure 3:
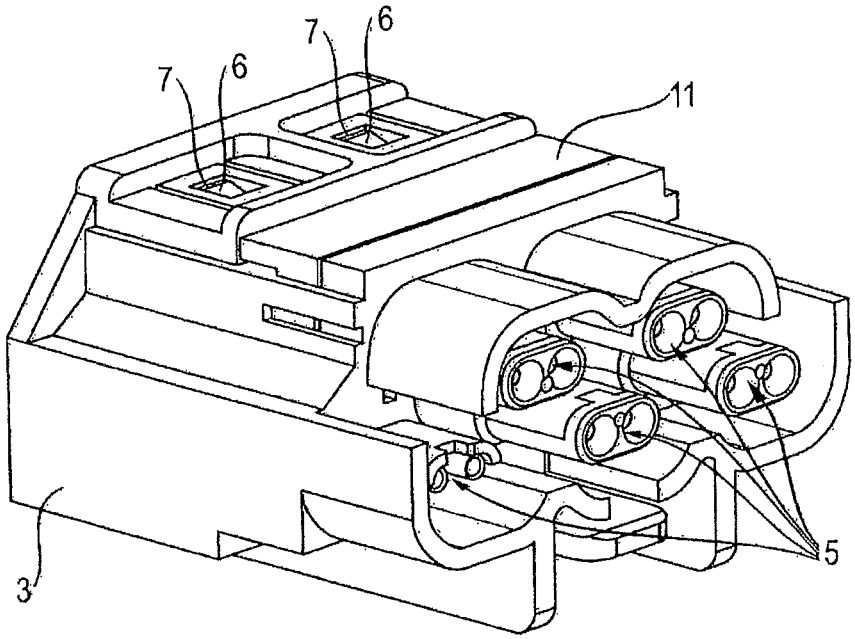
FIG. 3 shows a second view of the multiple plug-in connector.
Figure 4:
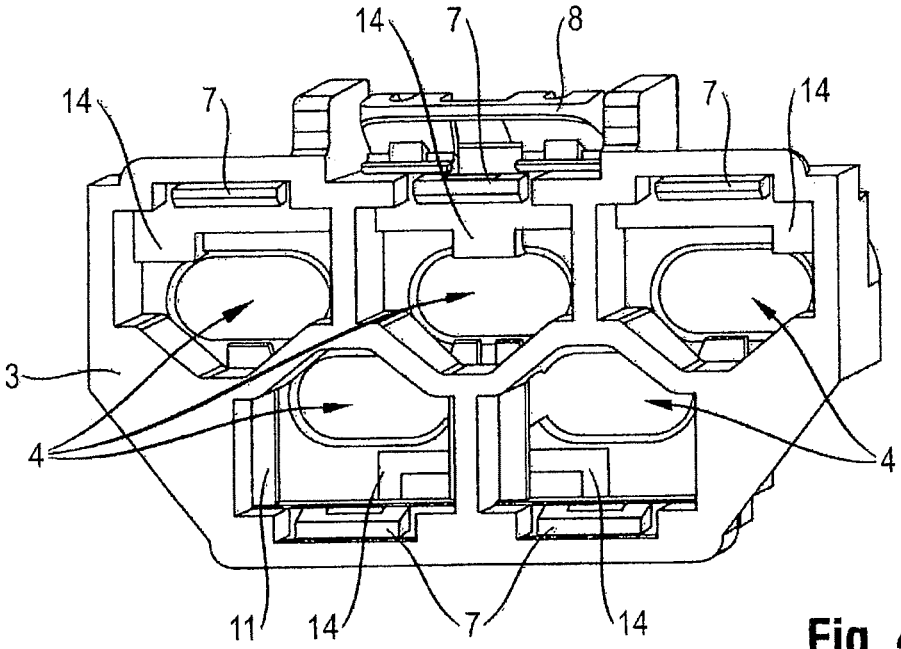
FIG. 4 shows the multiple housing of the multiple plug-in connector.

In describing the preferred embodiment of the present invention, reference will be made herein to FIGS. 1-14 of the drawings in which like numerals refer to like features of the invention.

A system according to the invention having a plurality of plug-in connectors which differ in terms of the shape of their housings is characterized in that the housings of the plug-in connectors are formed of several parts, whereby these first housing parts, which are identical at least in terms of the interfaces with the other components of the respective plug-in connectors, and are particularly preferably completely identical, have differing second housing parts.

"Formed of several parts" means that the housings are formed of at least two separate housing parts which are connected together, directly or indirectly, during assembly of the plug-in connector.

"Identical" means that the corresponding elements are identical in form and dimensions. Differences, for example in terms of the material, should be possible according to the invention.

"Interfaces" refers to the regions of the first housing parts which come into contact with the other components of the respective plug-in connector (in particular the second housing part and the contact element or elements).

Accordingly, it is preferably the case that the differences in the shapes of the housings of the different plug-in connectors are concentrated in a particular region, the second housing part, which means that the housings can otherwise, i.e., in terms of the first housing part, be identical in design. The use of identical first housing parts for the plug-in connectors means that the total number of housing components which are required for the creation of the different plug-in connectors, and thus stock keeping costs, can be kept low. In addition, the number of tools required for the manufacture of the housing components, in particular injection molds, can be kept low, which can also have a positive effect on the costs of manufacture. This can also simplify the automated assembly of the plug-in connectors with cables to be attached thereto.

In addition to the housing, the plug-in connectors of the system according to the invention also have at least one contact element which is arranged (in particular fixed) at least partially within the housing and has a plug-side end which is intended for making contact with a mating contact element of a mating plug-in connector for the respective plug-in connector.

The plug-in connectors are preferably intended for the transmission of high frequency signals. The plug-in connectors therefore also each preferably have at least two contact elements. Such plug-in connectors are suitable for connection to two wires of a twisted-pair cable. The contact elements are therefore preferably also characterized in that these each have a cable-side end which is intended for connection with a wire of a cable and is designed accordingly (for example through the provision of crimp tabs).

In order to make possible a simple assembly of the different plug-in connectors it can preferably be the case that the second housing parts have identical connecting means for connection with the first housing part. These connection means can in particular be designed such that these create a force-locking (clamping) and/or form-locking connection between the housing parts. Form-locking connections can in particular be designed as snap-locking connections which are characterized through the spring-loaded engagement of projections in recesses.

The manufacture and in particular the assembly of the plug-in connectors of the system according to the invention can be simplified in that the contact element or elements of each plug-in connector are in each case arranged in the first housing part and in particular are also fixed therein. A fixing of the contact elements can in particular be effected by snap-locking connections.

The system according to the invention is advantageously suitable for the design of a multiple plug-in connector, in which several plug-in connectors of the system are arranged and in particular fixed in or on a multiple housing. It can thereby particularly preferably be the case that the second housing parts of at least some, preferably all of the plug-in connectors are provided with different codings, by which the individual positions of the individual plug-in connectors on or in the multiple housing are assigned.

FIG. 1 shows a plug connection consisting of a multiple plug-in connector according to the invention 1 and a (multiple) circuit board plug-in connector 2 serving as a mating plug-in connector.

The multiple plug-in connector 1 comprises a multiple housing 3 with a plurality (in the present exemplary embodiment a total of five) receiving openings 4 arranged in parallel. A plug-in connector 5 according to the invention is in each case plugged into these receiving openings 4, where they are secured in place by a snap-locking connection. The snap-locking connections comprise projections 6 which are formed on the outer sides of housings of the plug-in connectors 5, as well as undercuts in the form of through-openings which are formed by locking latches 7 of the multiple housing 3. When the plug-in connectors 5 are plugged into the receiving openings 4 the projections 6 which rise obliquely in the plug-in direction deflect the locking latches 7 until the projections 6 engage in the through-openings of the locking latches 7. In order to release the snap-locking connections, the locking latches 7 can be raised manually and thus disengaged from the projections 6.

The multiple housing 3 also comprises a central locking latch 8, which is provided in order to form a snap-locking connection with a housing 9 of the circuit board plug-in connector 2, comprising for this purpose a projection 10 which rises obliquely in the plug-in direction.

Figure 6:
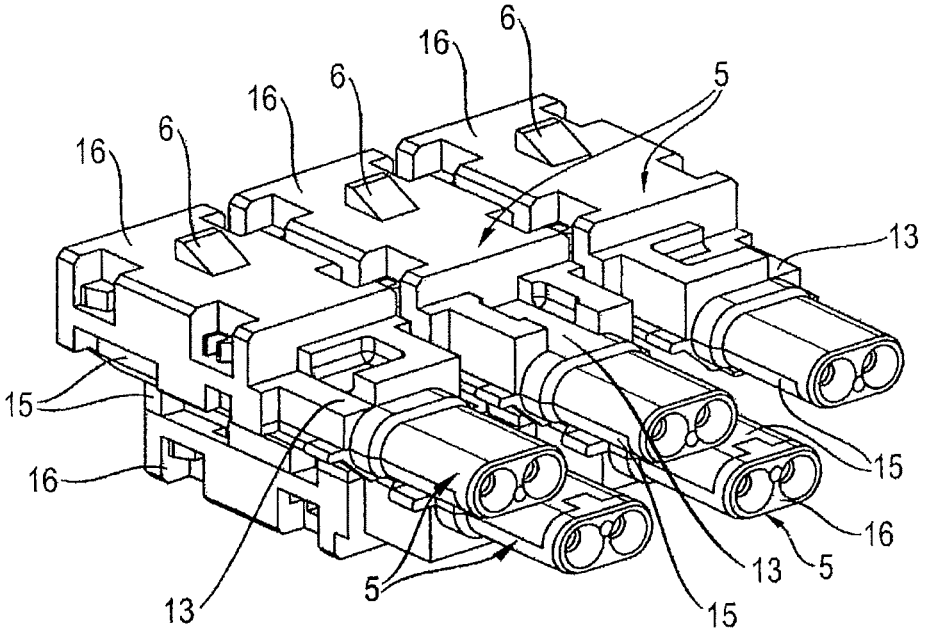
FIG. 6 shows a first view of the plug-in connectors of the multiple plug-in connector.
Figure 7:
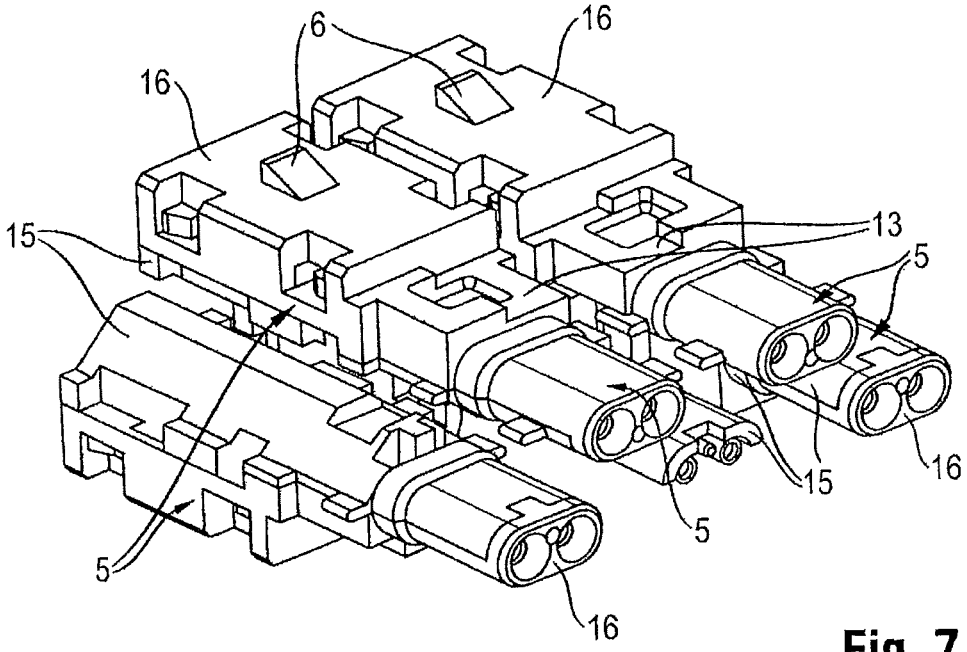
FIG. 7 shows a second view of the plug-in connectors of the multiple plug-in connector.
Figure 8:
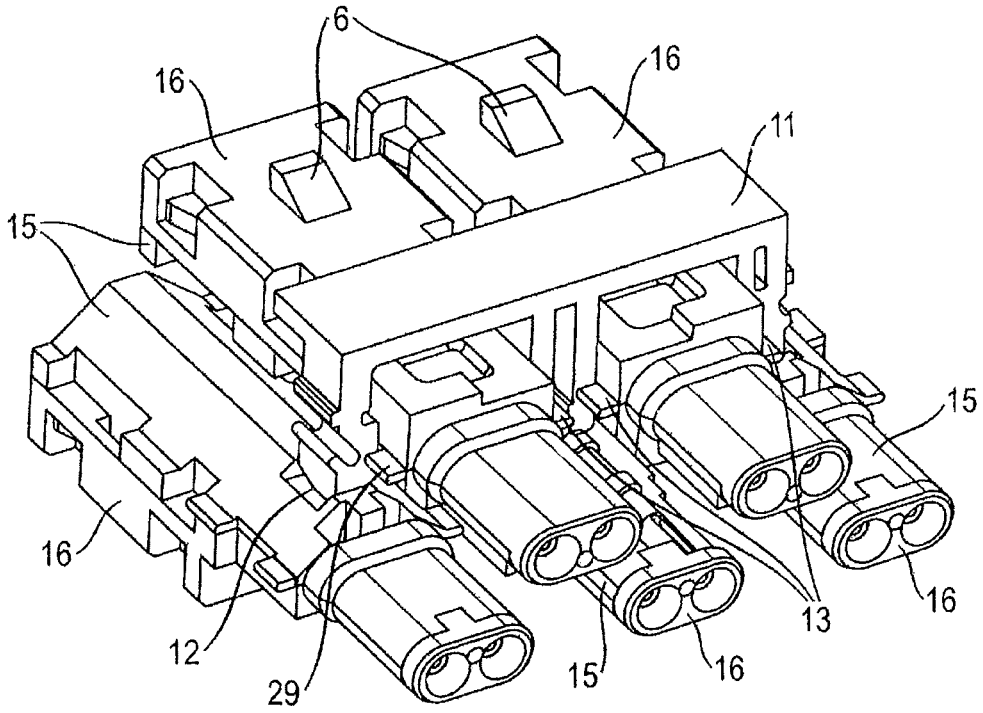
FIG. 8 shows the plug-in connectors of the multiple plug-in connector in the view according to FIG. 7 with a securing element of the multiple housing.

FIGS. 6 to 8 show the plug-in connectors 5 in the arrangement which these occupy within the multiple housing 3. Three of the five plug-in connectors 5 are thereby arranged in a first row and the two other plug-in connectors 5 in a second row parallel to this. The distance between the plug-in connectors 5 in the second row and the two adjacent plug-in connectors 5 in the first row is substantially equal, these thus being arranged centrally in relation to the latter. This allows a compact arrangement of the plug-in connectors 5 in the multiple housing 3 to be achieved, whereby at the same time the greatest possible distance from adjacent plug-in connectors 5 is maintained. This allows any cross-talk between the plug-in connectors 5 to be minimized.

In addition to the position of the plug-in connectors 5 within the multiple housing 3 being secured by the snap-locking connections, these are also secured within the multiple housing 3 by a bracket-formed securing element 11. The securing element 11 is plugged into the multiple housing 3 transversely to the plug-in direction, whereby ribs of the fixing element 11 project into the receiving openings 4. The ribs thereby engage in recesses 12 in the housings of the three plug-in connectors 5 which are arranged in a row, through which form-locking position locks in relation to the plug-in direction are formed. The position of the two plug-in connectors 5 which are arranged in a row are correspondingly secured in that the ribs are arranged between projections 29 on the housings.

The plug-in connectors 5 represent a system according to the invention and differ slightly in the external shape of the housing. This serves to form a coding for the individual positioning of the individual plug-in connectors 5 within the multiple housing 3. For this purpose the housings of the plug-in connectors 5 have recesses 13 running in a longitudinal direction which are positioned and/or dimensioned differently in the plug-in connectors 5. When the plug-in connectors 5 are plugged into the associated receiving openings 4 of the multiple housing 3, projections 14 of the multiple housing 3 slide into the recesses 13. If an attempt is made to plug the plug-in connectors 5 into the wrong receiving openings 4, it is not possible to do so as far as the end positions secured through the snap-locking connections due to a collision with the projections 14.

Figure 9:
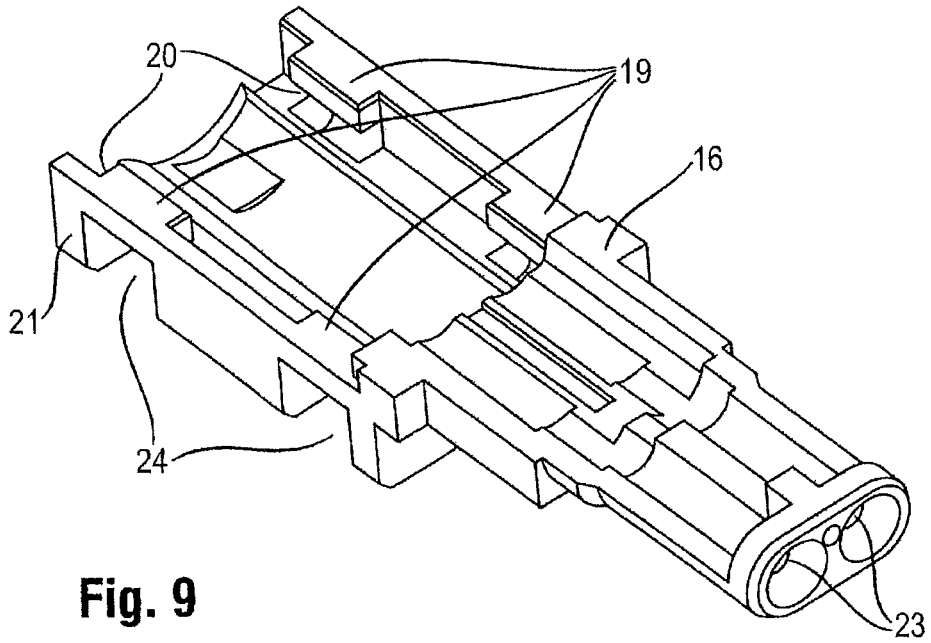
FIG. 9 shows a second housing part of one of the plug-in connectors.
Figure 10:
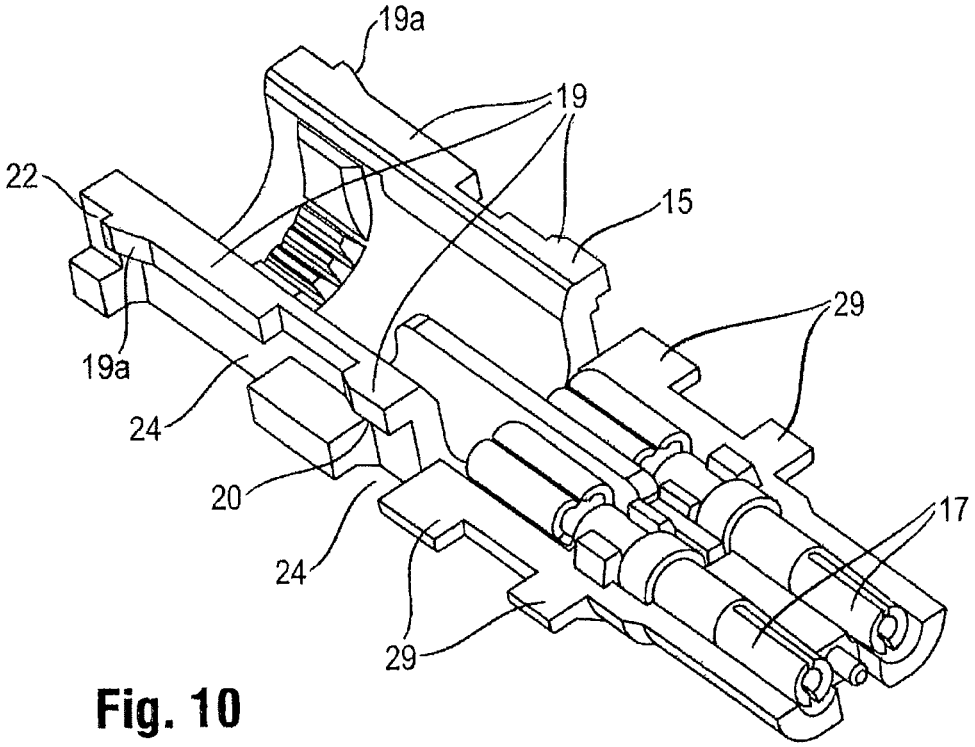
FIG. 10 shows a first housing part with contact elements which is identical for all plug-in connectors.
Figure 11:
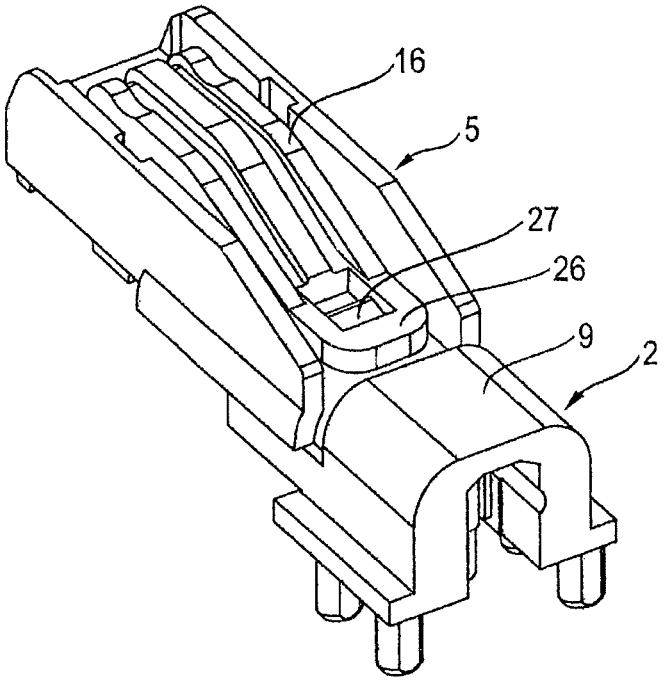
FIG. 11 shows a plug-in connector of a system according to the invention with a mating plug-in connector.
Figure 12:
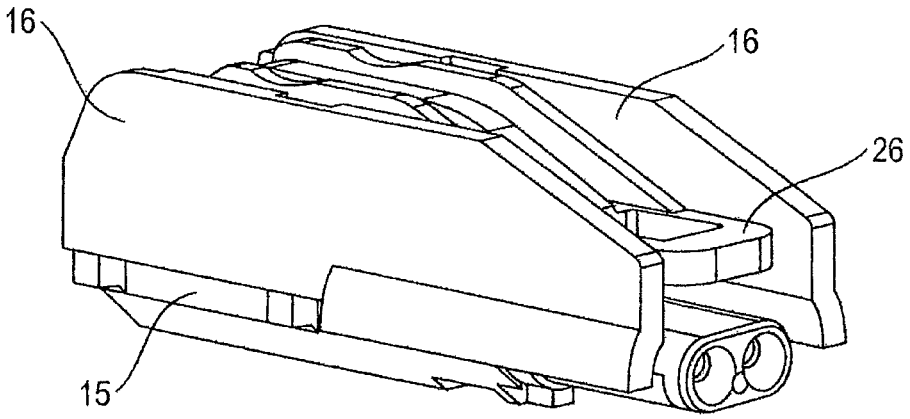
FIG. 12 shows the plug-in connector according to FIG. 11.
Figure 13:
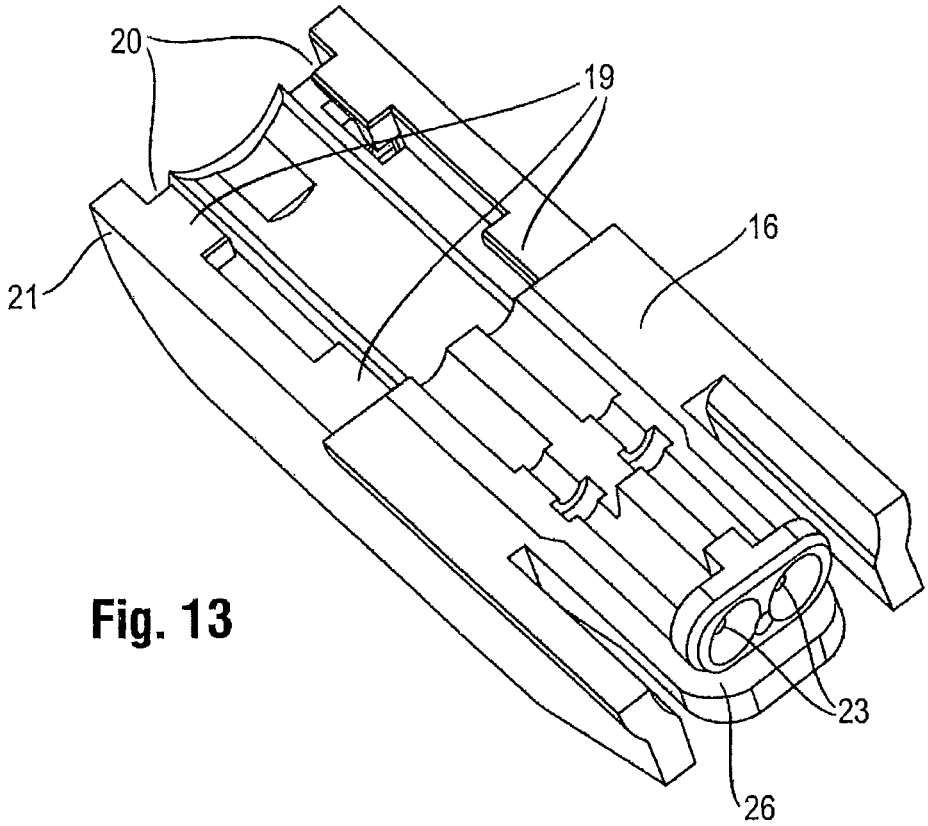
FIG. 13 shows the second housing part of the plug-in connector according to FIG. 12.
Figure 14:
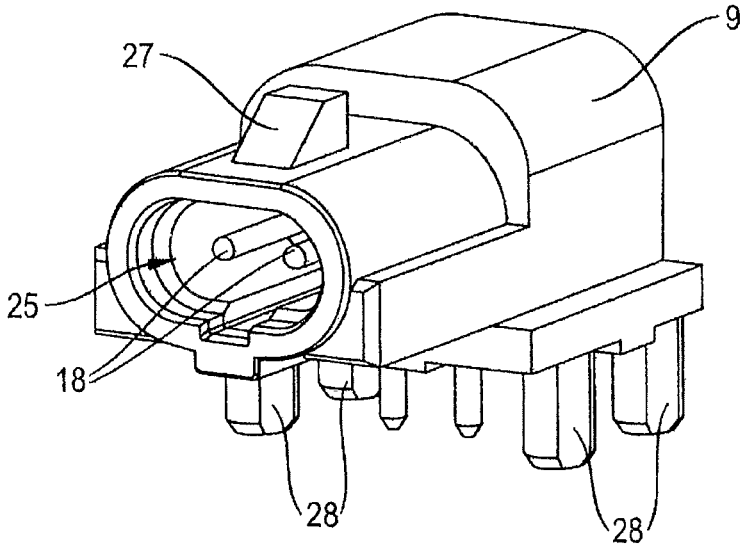
FIG. 14 shows the mating plug-in connector according to FIG. 11.

The housings of the plug-in connectors 5 are constructed in two parts. A first housing part 15 is identical in design for all plug-in connectors 5, while the second housing parts 16 (only) differ with respect to the integration of the recesses 13 forming the coding. FIG. 10 shows a first housing part 15. FIG. 9 shows a second housing part on the side forming the inner side of the corresponding housing. On this side, the second housing parts 16 of all plug-in connectors 5 are identical in design.

In addition to the housing, the plug-in connectors 5 each have two contact elements 17 which are fixed within the housing and have plug-side as well as cable-side ends. On the cable-side ends, the contact elements 17 can be connected by crimped connections with wires of a (twisted-pair) cable (not shown). For this purpose, the plug-side ends are designed to make contact with complementary contact elements 18 of the circuit board plug-in connector 2, whereby the socket-formed contact elements 17 of the plug-in connectors 5 receive pin-formed contact elements 18 of the circuit board plug-in connector 2 and are thereby elastically widened in a radial direction, which is made possible through corresponding longitudinal slits.

The positional fixing of the contact elements 17 in the housings is realized through peripheral projections on the contact elements 17 which are arranged in peripheral grooves in the housing.

The two housing parts 15, 16 of the plug-in connectors 5 each have a plug-side section in which the contact elements 17 are arranged in the assembled state of the plug-in connectors 5. In this section the dividing plane between the housing parts 15, 16 is aligned coplanar to the plane spanned by the longitudinal axes of the two contact elements 17 (which, with the exception of the crimped connections, have circular or ring-formed cross sections). Each housing part 15, 16 also has a cable-side section which serves to receive a section of the cable which is accommodated in the housing. In this section the dividing plane is aligned parallel to the plane spanned by the longitudinal axes of the contact elements 17.

In the respective cable-side section, both housing parts 15, 16 each form four projections 19 adjacent to the dividing plane, whereby in each case two projections 19 are arranged on each side of both housing parts 15, 16, spaced apart in the longitudinal direction of the plug-in connector 5. The two projections 19 also form a limit for a recess 20 extending in a longitudinal direction on each side of both housing parts 15, 16.

In order to assemble the plug-in connector 1, the two housing parts 15, 16 are positioned offset relative to one another in the longitudinal direction in such a way that the projections 19 of one housing part 15, 16 are arranged next to the projections 19 of the other housing part 15, 16. This allows the housing parts 15, 16 to be plugged together until the contact surfaces of both housing parts 15, 16 forming the dividing plane come into contact (in a direction perpendicular to the longitudinal direction), without the projections 19 colliding. The projections 19 of both housing parts 15, 16 are then located in the recesses 20 of the other housing part 15, 16.

A connection of the housing parts 15, 16 is then effected by displacing these relative to one another in a longitudinal direction until the end position shown in FIGS. 6 to 8 is reached. In this end position the four projections 19 of both housing parts 15, 16 at least partially cover each other. This prevents the housing parts 15, 16 from becoming detached in a direction transverse to the longitudinal direction of the plug-in connectors 5.

A mutual detachment of the housing parts 15, 16 in a longitudinal direction is prevented through a snap-locking connection. This is in each case formed by snap-locking sections 19*a* of the cable-side projections 19 of the first housing part 6 in interaction with a cable-side end section 21 of the second housing part 16. The snap-locking sections 19*a* widen in the direction of the cable-side end of the first 6 housing part, as a result of which contact surfaces running obliquely to the longitudinal direction are formed. The end section 21 of the second housing part 16 is pushed onto these contact surfaces, whereby the inner width of the end section 21 is less than the maximum width between the two snap-locking sections 19*a*. The end section 21 of the second housing part 16 is therefore widened elastically when passing over the snap-locking sections 19*a* and in consequence snaps behind these in the end position.

On snapping behind the snap-locking sections 19*a*, the end section 21 of the second housing part 16 cannot completely return to its original form but, widened elastically, lies against contact surfaces of an end section 22 of the first housing part 15. For this purpose, the first housing part 15 has a greater width in the region of these contact surfaces than in the region of the recesses 20.

As a result of the end section 21 of the second housing part 16 being elastically spread and thus pre-tensioned in contact, the end section 22 and, partially, the adjoining section of the first housing part 15 are compressed, as a result of which the reception space formed within the first housing part 15 is reduced in these sections. This leads to a clamping fixing of a cable sheath of the cable located in these sections. This fixing serves, on the one hand, as a strain relief for the connection between the contact elements 17 and the wires of the cable and is on the other hand intended to prevent the cable from twisting within the housing.

The connection of the cable within the housing is further improved through several projections 23 of the first housing part 15 arranged peripherally in the wall of the reception space (around the longitudinal direction of the respective plug-in connector 5) in the vicinity of the end section 22. As a result of the deformation of the first housing part 15, these penetrate into the cable sheath, as a result of which a form-locking connection is formed.

The wires of the cable should also display twisted arrangements in the sections within the housing of the plug-in connectors from which the cable sheathing has been stripped. The twisting should thereby correspond as far as possible to that which the wires display within the cable sheathing. Through the fixture of the plug-side ends of the conductors in the contact elements 17, which are in turn fixed within the housing, as well as through the securing of the cable sheaths against twisting by means of the clamping fixings, it can be adequately ensured that the wires do not become untwisted in the sections of the cable from which the cable sheathing has been stripped.

The two housing parts 15, 16 of the plug-in connectors 5 are completely formed of non-electrically-conductive plastic, whereby the simple geometrical shape advantageously makes injection molding possible. With a demolding direction which is aligned perpendicular to the dividing planes, only the second housing parts have undercuts in the form of plug-side through-openings 23 which can be created with the aid of a slide in the injection mold. Due to the provision of demolding recesses 24, the projections 19 do not represent undercuts during demolding.

No shielding for the plug-in connectors 5 integrated within the housing is provided. Due to the twisting of the wires substantially being continued as far as the contact elements 17, the transmission performance of the plug-in connectors (with twisted-pair cables connected thereto) is sufficiently good for many high frequency applications.

Figure 5:
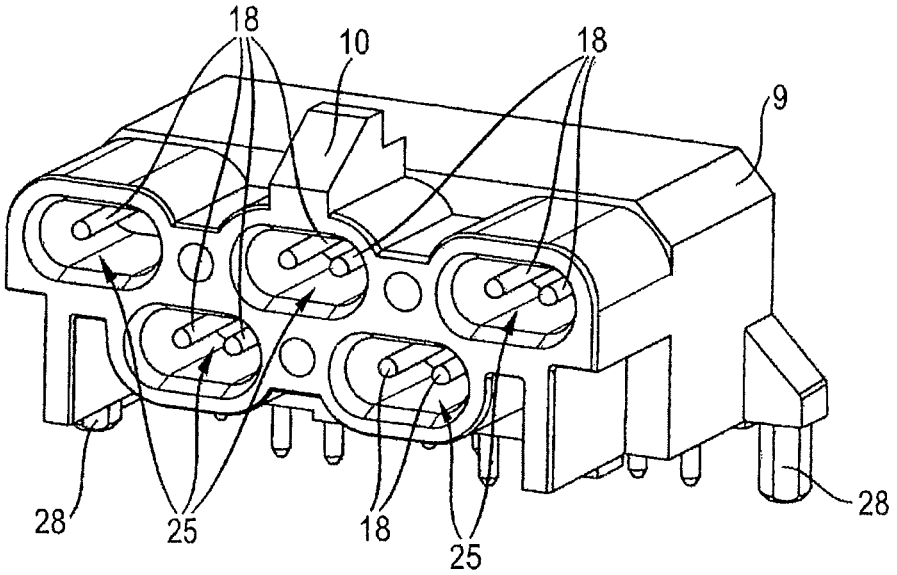
FIG. 5 shows the mating plug-in connector.

In FIG. 5 the circuit board plug-in connector 2 is shown in isolation. The housing 9 of the circuit board plug-in connector 2 forms a plug interface on one side which is complementary to a plug interface formed by the multiple plug-in connector 1. The plug interface of the circuit board plug-in connector 2 comprises several (in this case five) (through) openings 25, within each of which two of the contact elements 18 (a contact element pair) are arranged in parallel alignment. In the plugged-together state of the plug connection these make contact with the contact elements 17 of the multiple plug-in connector 1. The cross sections of the openings 25 of the housing 9 are elongated-oval and correspond to the cross sections of the plug-side sections 28 of the housings of the plug-in connectors 5. A (plug) section of the outside of the housing 9 surrounding the openings 25 has a shape which is complementary to the inner side of a plug section of the multiple housing 3. In the plugged-together state of the plug connection, the plug-side sections 28 of the plug-in connectors 5 thus project into the openings 25 of the housing 9 of the circuit board plug-in connector 2 and the plug section of the housing 9 of the circuit board plug-in connector 2 projects into the plug section of the multiple housing 3. In combination with the fixing through the snap-locking connection (locking latch 8 and projection 10) this allows a high mechanical load-resistance of the plug connection to be achieved.

The contact elements 17 follow a path angled at 90° within the housing 9. The circuit-board-side ends of the contact elements 17 project beyond the housing 9 of the circuit board plug-in connectors 2, so that these can make contact with contact points of a circuit board (not shown). The ends of the contact elements can thereby engage into openings in the circuit board in order also to connect the circuit board plug-in connectors 2 mechanically with the circuit board. Additional mechanical stability is provided by pin-formed projections 28, which can engage in corresponding openings in the circuit board.

The housing 9 of the circuit board plug-in connectors 2 is also formed completely of non-electrically-conductive plastic, whereby the geometrically simple shape simplifies manufacture through injection molding.

FIGS. 11 to 14 show a plug connection with a plug-in connector which is also part of the system according to the invention, which also includes the plug-in connectors of the multiple plug-in connector shown in FIGS. 1 to 8. In this case the plug-in connector is designed as a single plug-in connector and is intended for connection with a corresponding (single) mating plug-in connector. The mating plug-in connector is in turn designed as a circuit board plug-in connector 2.

As part of the system according to the invention, the housing of the plug-in connector 5 comprises a first housing part 15, which is identical to the first housing parts 15 of the plug-in connectors 5 of the multiple plug-in connector 1. The second housing part 16 is, in contrast, modified for use as a single plug-in connector. For this purpose the second housing part 16 comprises an elastically deflectable locking latch 26 with an opening into which an obliquely rising projection 27 of the housing 9 of the circuit board plug-in connector 2 can engage when the plug connection is plugged together. On the side forming the inner side of the housing 9 the shape of the second housing part 16 is, insofar as this interacts with the first housing part, identical to that of the second housing parts 16 of the plug-in connectors 5 of the multiple plug-in connector 1.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A multiple plug-in connector comprising:

a plurality of plug-in connectors, each with a housing, the housings differing in shape; and a multiple housing fixing in place the plug-in connectors, wherein the housings of the plug-in connectors have first housing parts which are identical in shape and dimensions and differing second housing parts, the second housing parts of at least some of the plug-in connectors including different codings for assignment to individual positions on or in the multiple housing which are formed by recesses into which projections of the multiple housing engage.

2. The multiple plug-in connector of claim 1, wherein the second housing parts have connections for connecting with the first housing parts, wherein the connections of the second housing parts are identical.

3. The multiple plug-in connector of claim 1, including contact elements arranged in the first housing parts.

4. The multiple plug-in connector of claim 2, including contact elements arranged in the first housing parts.

* * * * *